US005946899A

United States Patent [19]

Wassenhoven

[11] Patent Number: 5,946,899

[45] Date of Patent: Sep. 7, 1999

[54] SLIVER OPENING DEVICE

[75] Inventor: Heinz-Georg Wassenhoven, Moenchengladbach, Germany

[73] Assignee: W. Schlafhorst AG & Co., Moenchengladbach, Germany

[21] Appl. No.: 09/030,294

[22] Filed: Feb. 25, 1998

[30] Foreign Application Priority Data

Mar. 6, 1997 [DE] Germany ..... P 197 09 213

[51] Int. Cl.[6] ..... D01H 11/00

[52] U.S. Cl. ..... 57/301; 57/406; 57/407; 57/408; 57/411

[58] Field of Search ..... 57/301, 406, 407, 57/408, 411, 412

[56] References Cited

U.S. PATENT DOCUMENTS

| | | | |
|---|---|---|---|
| 3,924,397 | 12/1975 | Stahlecker et al. | 57/408 |
| 3,959,961 | 6/1976 | Stahlecker | 57/408 |
| 5,398,494 | 3/1995 | Wassenhoven et al. | 57/406 |
| 5,611,195 | 3/1997 | Lovas et al. | 57/406 |
| 5,647,196 | 7/1997 | Wassenhoven | 57/406 |
| 5,813,211 | 9/1998 | Stahlecker | 57/406 |

FOREIGN PATENT DOCUMENTS

| | | |
|---|---|---|
| 29 04 841 A1 | 8/1980 | Germany . |
| 32 21 385 A1 | 12/1983 | Germany . |
| 42 34 587 A1 | 4/1994 | Germany . |

*Primary Examiner*—William Stryjewski
*Attorney, Agent, or Firm*—Kennedy Covington Lobdell & Hickman, LLP

[57] ABSTRACT

In an open-end spinning unit 1 having a pivotably mounted cover element 8 for covering a rotor housing 2 of the spinning unit 1, a sliver opening device is incorporated into the cover element 8. The sliver opening device has an opening cylinder housing 17 fixed to the cover element 8 with an opening cylinder 21 supported by the housing 17 for rotational sliver opening operation. The housing 17 defines a sliver infeed position and a downstream soil discharge opening 28. The opening cylinder housing further includes side walls 43, 44 perpendicular to the axis of the opening cylinder 21, the side walls presenting inner wall surfaces 45 which diverge at least in the area of the soil discharge opening 28 toward respective wall edges 49.

12 Claims, 3 Drawing Sheets

SLIVER OPENING DEVICE

BACKGROUND OF THE INVENTION

The present invention relates generally to a sliver opening device of an open-end spinning unit and, more particularly, to such a sliver opening device having an opening cylinder housing which is fixed on a pivotably mounted cover element of the spinning unit with a soil discharge opening arranged in the direction of rotation of the opening cylinder behind a sliver infeed position.

Such sliver opening devices are known in various designs and are described e.g. in German Patent Publications DE 29 04 841 A1 or DE 32 21 385 A1. As is known, the separation of soil at the opening cylinder housing is an important element in achieving an unobjectionable processing of the fibrous materials in open-end rotor spinning.

Even though the technology of soil separation devices has long been known and appears to be relatively simple, these devices nevertheless can present design difficulties because the devices often react sensitively to changes. Even small modifications to the separation of soil influence the performance not only as regards the amount of soil separated but also the result of spinning on the whole.

As is known and described e.g. in German Patent Publication DE 29 04 841 A1, the sliver fed between a sliver drawing-in roller and a feed trough is separated by the opening cylinder into individual fibers. During this process soil particles are also separated from the fibers to a very great extent. The opening cylinder transports both components over a fiber guide surface into the area of a soil discharge opening. During this transport both the fibers and the soil particles are accelerated by the opening cylinder and by a current of air rotating with the opening cylinder in a very brief time to a high circumferential speed. The massive particles, that is, fibers and soil particles, have the tendency, as a consequence of the centrifugal force acting on them, to leave the circular path tangentially as soon as the mechanical guidance of the fiber guide surface is interrupted, as happens in the area of the soil discharge opening.

In order to prevent spinnable fibers from loosening from the opening cylinder in addition to the soil particles in the area of the soil discharge opening the soil discharge opening also serves as a suction opening for an additional current of air to enter into the opening cylinder housing. This additional current of air is directed onto the opening cylinder, and because the spinnable fibers on the opening cylinder have a relatively large specific surface in proportion to their low mass, this air current acts essentially in the manner of a "pneumatic guide" to hold the spinnable fibers firmly on the opening cylinder. Soil particles, on the other hand, which have a distinctly greater kinetic energy on account of their greater mass, overcome this air current and are cast off tangentially. In such devices the quality of the cleaning, that is, the quantity of the cleaned-out trash particles as well as the loss of useable fibers, is dependent to a great extent on the correct intensity and the direction of this additional current of air.

The known sliver opening devices, such as described e.g. in German Patent Publication DE 29 04 841 A1, have proven satisfactory in practice. However, occasional problems can occur during operation in sliver opening devices designed in this manner which can be traced back to an incomplete opening of the sliver. That is, there is the danger in the known sliver opening devices that the supplied sliver gradually widens during operation to the point of finally extending laterally beyond the area of the opening cylinder clothing into the area of the side flanges of the opening cylinder, which side flanges limits the opening cylinder clothing. In this instance, fiber clumps can detach from the sliver in an uncontrolled manner, which subsequently results in yarn errors or yarn breaks.

In order to prevent the sliver from being able to turn aside into the area of the side flanges, it has been attempted to lower the side flanges of the opening cylinders behind corresponding wall parts of the opening cylinder housing. German Patent Publication DE 32 21 385 A1 shows a device designed in this manner. As a result of the lowered mounting of the opening cylinder side flanges, the shifting of the sliver into these areas can be avoided. However, the lowered mounting of the opening cylinder side flanges results in a distinct reduction of the width of the soil discharge opening.

Since a vacuum must prevail in the rotor housing of an open-end spinning unit during the spinning process, it is necessary to constantly remove a certain amount of air by suction. The reduction of cross section in the area of the soil discharge opening results in an increase of the rate of flow of the additional current of air entering the opening cylinder housing. This increase of the rate of flow results, in turn, in problems in separating out relatively light trash particles since they are unable to overcome the relatively stronger additional current of air entering the opening cylinder housing. The area at the lower edge of the soil discharge opening is particularly critical since the soil particles in this area have already lost a large part of their kinetic energy so that there is the danger that the light trash particles may be completely braked by the opposing air current and may be subsequently transported back to the opening cylinder.

SUMMARY OF THE INVENTION

In view of the known sliver opening devices of the type described above, the present invention therefore has the object of improving such known silver opening devices, especially by modifying the opening cylinder housing, so as to overcome the afore-described problems.

The present invention is basically adapted to a sliver opening device for an open-end spinning unit of the type having an opening cylinder housing fixed to a pivotably mounted cover element for the spinning unit and supporting an opening cylinder for rotational sliver opening operation, wherein the housing defines a sliver infeed position and a soil discharge opening located downstream of the sliver infeed position in the direction of rotation of the opening cylinder. In accordance with the present invention, the opening cylinder housing comprises side walls having respectively opposing inner wall surfaces which diverge with respect to one another away from the opening cylinder toward a wall edge at least in the area of the soil discharge opening.

This design of the inner wall surfaces of the side walls of the opening cylinder housing in accordance with the present invention causes the wall surfaces to diverge in the direction of flight of the separated soil particles and has the particular advantage of enabling the rate of flow of the entering additional current of air to be distinctly reduced by widening the cross section in the critical flow area such that prior problems in this zone are able to be decisively neutralized as a result. Moreover, this design of the inner walls assures that the exiting soil particles do not strike against the inner wall surfaces and lose their kinetic energy thereby. Thus, the diverging design of the inner walls assures that trash particles are reliably removed counter to the entering current of air.

In an advantageous embodiment the inner wall surfaces comprise respective inner sections which are oriented orthogonally to the axis of the opening cylinder so as to be arranged in parallel relation to one another and respective divergingly inclined edge sections connected to said inner sections. Such a design assures continuous flow conditions in the area of the soil discharge opening with the air flow being weakest in the critical outer area.

In such embodiment, the edge areas are advantageously designed as planar surfaces since such plane surfaces can be produced relatively economically. The angle of inclination between the inner areas and the edge areas is preferably between 3° and 25°. Optimal flow conditions are achieved in particular at angles of inclination located in this range. The angles of inclination between the inner areas and the respective edge areas can either be designed to be uniform, which simplifies manufacture, or, may be oriented at differing angles, which can offer advantages in the case of special spinning materials since a sensitive adaptation of the flow conditions is possible in this manner. The edge areas terminate with advantage in a wall edge which has a uniform thickness along its entire length.

In another preferred embodiment, the inner wall surfaces of the side walls of the opening cylinder housing extend divergently toward the wall edges, that is, in the direction of flight of the trash particles, in a convex curvature. More specifically, each of the side walls has an inner wall section with a ring segment section beginning in the area of a bore for the shaft of the opening cylinder and arranged orthogonally to the axis of the opening cylinder and a convexly curved inner connection surface which diverges increasingly toward the wall edge. Thus, the convex curvature of the inner wall extends without transition over the entire wall section, which results in optimal flow conditions. The terminal wall edges preferably have a uniform thickness along their entire length.

In the preferred embodiments, the opening cylinder housing is designed in one piece. In this manner transitional slots and joints or seams, which experience has shown pose potential sources of errors in sliver opening devices, are avoided during manufacture. It is also preferred that the opening cylinder housing be formed at its front side with a cylinder receiving opening having a dual graduated profile which results in conjunction with a corresponding design of the frontal cover flange of the opening cylinder in a labyrinth-like seal of the cylinder receiving opening. In this manner, the entrance of unintended air and therewith the formation of fly or fluff can be avoided to a very great extent.

The opening cylinder housing also preferably has a stepped bore connected tangentially with respect to the cylinder receiving opening for replaceably receiving a fiber guide conduit. This design advantageously makes it possible to insert and remove the fiber guide conduit without problems if needed.

Further details, aspects and advantages of the present invention will be described and understood from the following disclosure of exemplary embodiments with reference to the accompanying drawings.

DETAILED DESCRIPTION OF THE PREFERRED EMBODIMENTS

Figure 1:
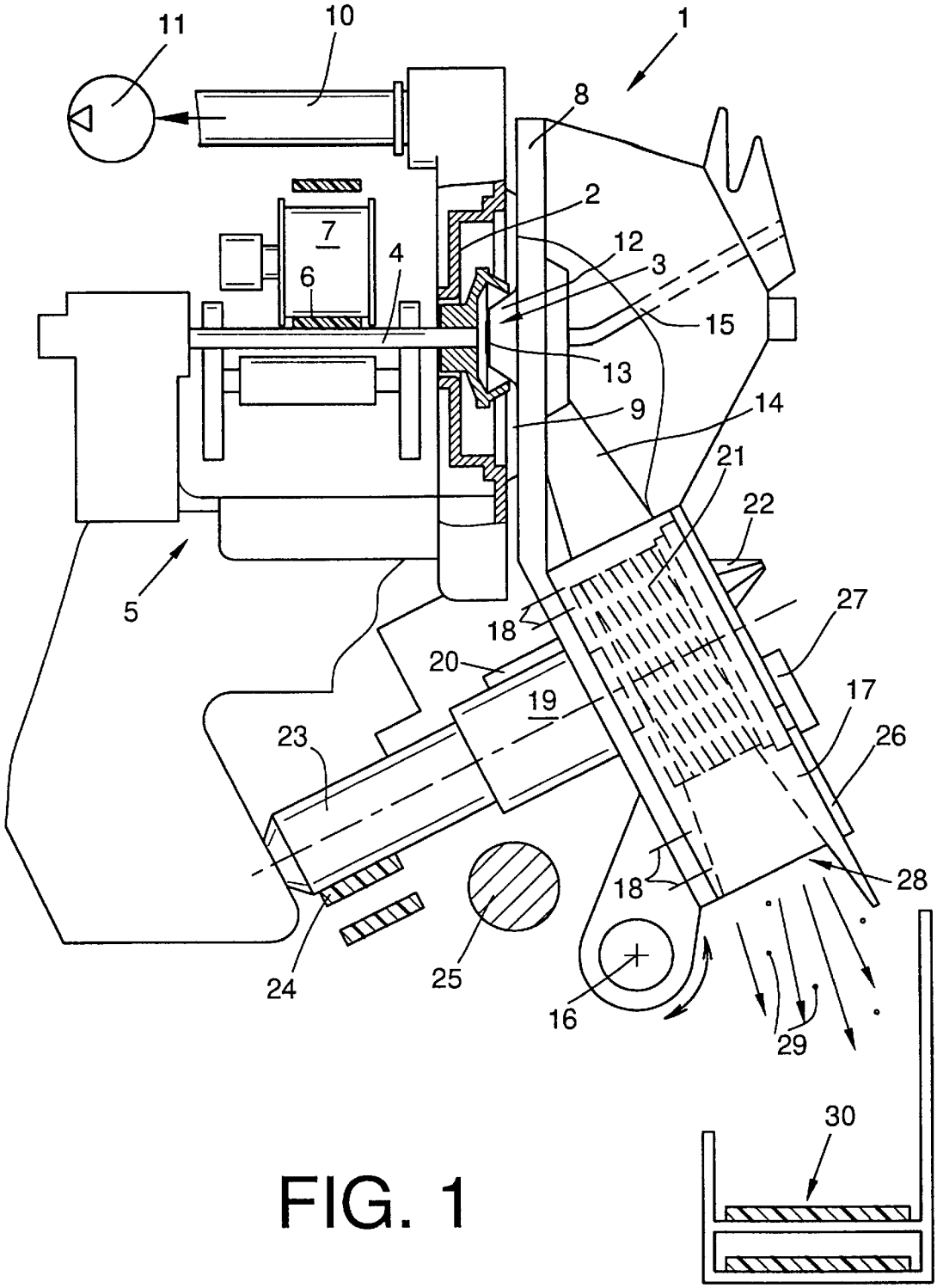
FIG. 1 is a side elevational view, partially in cross-section, of an open-end spinning unit with a sliver opening device in accordance with the present invention arranged in a cover element of the unit.

Referring now to the accompanying drawings and initially to FIG. 1, one representative open-end spinning unit of a spinning machine having a plurality of such spinning units supported in alignment with one another along then length of the machine is shown and designated in its entirety by the reference numeral 1. As is known, the spinning unit has a rotor housing 2 in which a spinning rotor 3 rotates at a high speed. Spinning rotor 3 is supported by a rotor shaft 4 in the nip area between the disk pairs of a conventional support disk bearing 5 and is driven by a tangential belt 6 which runs the length of the machine, with a backup pressure roller 7 engaged against the opposite side of the belt 6 to maintain it in driving contact with the shaft 4.

Rotor housing 2 is open toward the front side of the spinning unit 1 but is covered during operation by a pivotably mounted cover element 8 having a conduit plate (not shown in detail) with a seal 9 to securely enclose the housing 2. The rotor housing 2 is connected via an appropriate suction line 10 to a vacuum source 11 which generates the necessary spinning vacuum in rotor housing 2.

A conduit plate extension portion, sometimes commonly referred to as a conduit plate adapter 12, is carried by the cover element 8, preferably in a replaceable manner, to extend into the rotor 3 when the cover element 8 is in covering relation to the rotor housing 2. The adapter 12 is equipped with a yarn draw-off nozzle 13 which connects with a following yarn draw-off tube 15 for withdrawing from the spinning rotor 3 yarn spun therein and the adapter 12 also carries the mouth area of a fiber guide conduit 14 for delivering opened fibers into the rotor 3 for spinning.

An opening cylinder housing 17 is fixed, e.g. by screw bolts 18, to the cover element 8 and the cover element 8, in turn, is mounted by appropriate fitting means so that it can pivot in a limited manner about an axis 16 toward and away from the rotor housing 2 into and out of covering relation thereto. Cover element 8 comprises bearing brackets 19, 20 on its rearward side for mounting an opening cylinder 21 and a sliver drawing-in cylinder 22 for drawing into the opening cylinder housing 17 a sliver fed form a suitable source of supply, e.g., a sliver can or the like (not shown). The opening cylinder 21 has a shaft 23 supported in the bearing bracket 19 and extending rearwardly therefrom, by which the opening cylinder 21 is driven by a traveling tangential belt 24 running the length of the spinning machine. The drive of sliver drawing-in cylinder 22 (not shown) preferably comprises a worm gear arrangement connected to a drive shaft 25 extending the length of the machine.

Opening cylinder housing 17, which is explained in more detail hereinafter with reference to FIGS. 2 to 5, is closed at its forward side during the spinning process by a closure cover 26 secured in place by a lever 27. Opening cylinder housing 17 has a soil discharge opening 28 in its lower area, which opening is arranged behind (i.e. downstream of) the sliver drawing-in cylinder 22 as viewed in the direction of rotation of the opening cylinder 21 and through which opening soil particles 29 released from the incoming sliver are separated onto and removed by a soil removal device 30, only schematically represented in FIG. 1.

Figure 2:
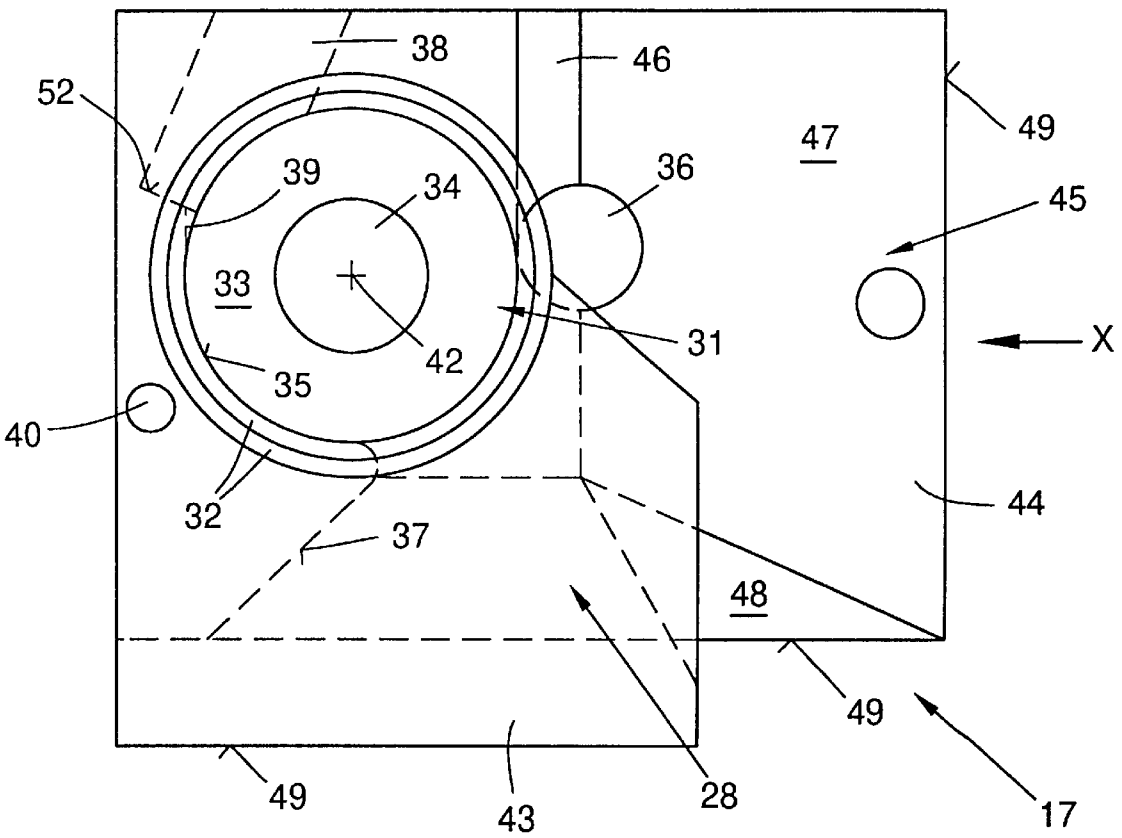
FIG. 2 is a front elevational view of a first exemplary embodiment of an opening cylinder housing of the sliver opening device, in accordance with the present invention.
Figure 3:
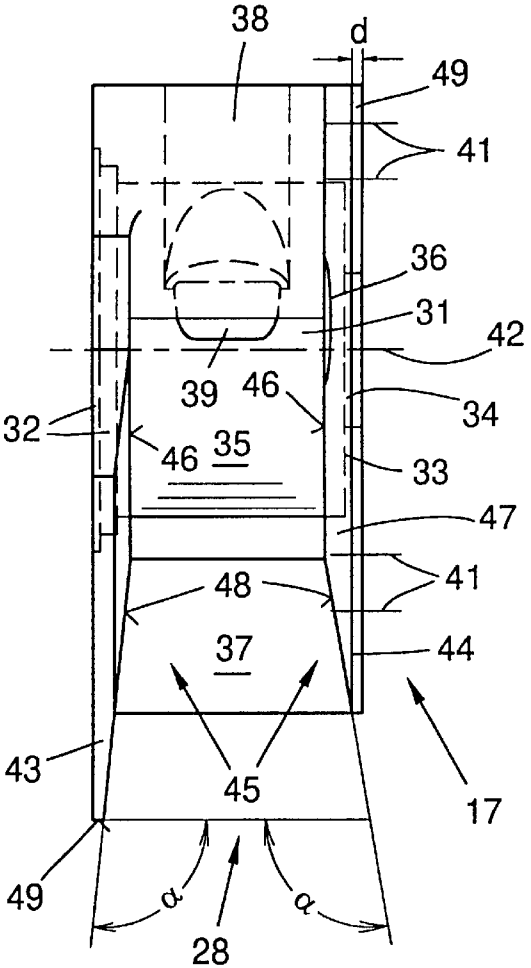
FIG. 3 is an end elevational view of the opening cylinder housing according to FIG. 2 as viewed along arrow X thereof.

FIGS. 2 and 3 show a first embodiment of an opening cylinder housing 17 in accordance with the invention. The opening cylinder housing 17 has a cylinder receiving opening 31 profiled with dual graduations 32 on its front side. A bore 34 is formed into a rear basal surface 33 of the cylinder receiving opening 31 through which extends the shaft 23 of opening cylinder 21. A circumferential surface 35 of the cylinder receiving opening 31 is open between a sliver infeed position at which the circumferential surface 35 meets a bore 36 for the sliver drawing-in cylinder 22 and a baffle 37, such opening in the circumferential surface 35 forming, among other things, a soil discharge opening 28 in this area. Cylinder receiving opening 31 also has a tangential extension 39 whereat the cylinder receiving opening 31 opens into communication with a tangential stepped bore 38 which serves to receive replaceable a sliver guide conduit 14 by which opened fibers are delivered to the rotor housing 2. The opening cylinder housing 17 has a bearing bore 40 for the retaining lever 27 as well as threaded bores 41 for fastening the opening cylinder housing 17 to the cover element 8.

Opening cylinder housing 17 has a front side wall 43 and a back side wall 44 each arranged orthogonally to the rotational axis 42 of opening cylinder 21 as defined by the bore 34. In the exemplary embodiment according to FIGS. 2 and 3, the inner wall surface 45 of each of the side walls 43, 44 consists of three wall sections. An inner section 46 of each side wall 43, 44 extends orthogonally to axis 42 of opening cylinder 21, whereby the respective inner sections 46 of the side walls 43, 44 extend parallel to each other. The inner section 46 of each side wall 43, 44 merges with two following edge sections 47, 48 which are outwardly inclined, such that the opposing edge sections 47, 48 of the side walls 43, 44 diverge toward their respective wall edges 49. The respective surfaces of the edge sections 47, 48 are arranged at an angle $\alpha$ relative to axis 42 of opening cylinder 21 which is greater than 90°, preferably at an angle cc of 93° to 115°. Thus, the diverging edge sections are arranged at an angle to the inner sections preferably between 3° and 25°.

Figure 4:
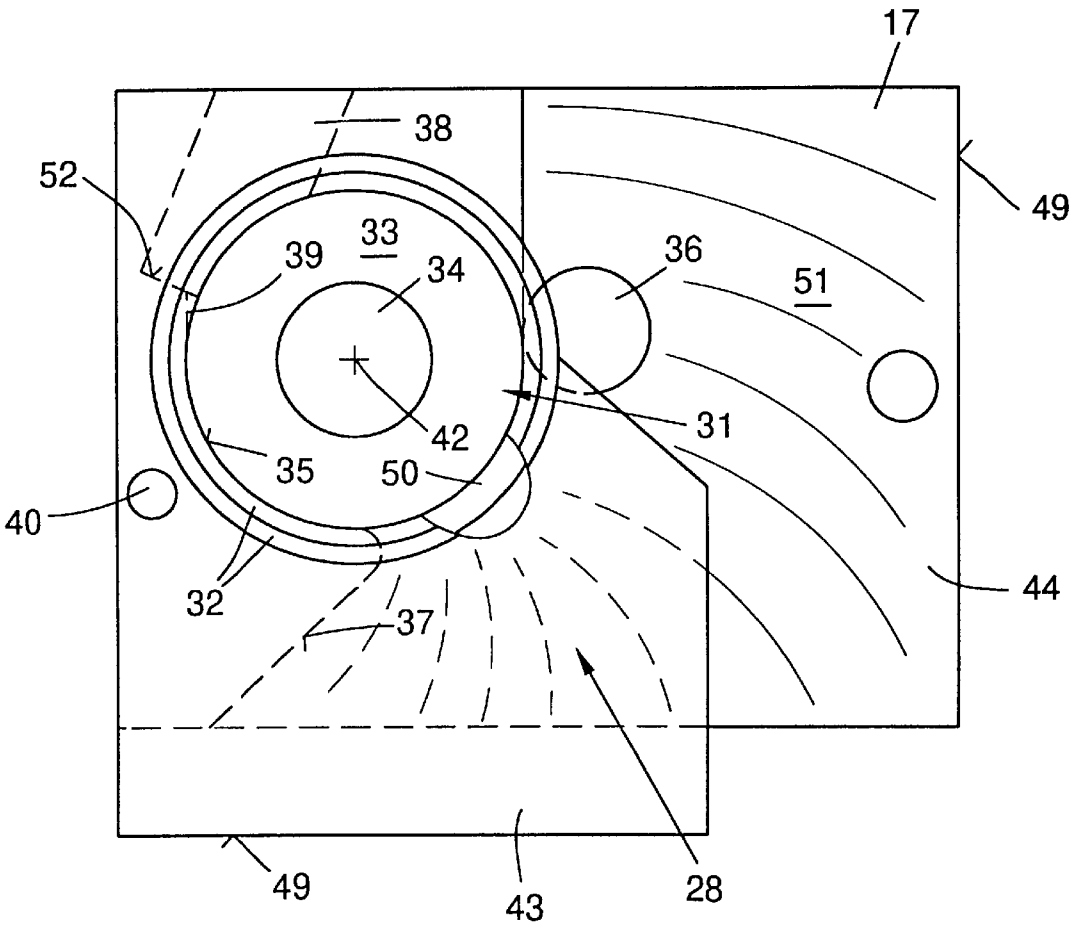
FIG. 4 is another front elevational view similar to that of FIG. 2 showing another preferred exemplary embodiment of the opening cylinder housing of the present invention.
Figure 5:
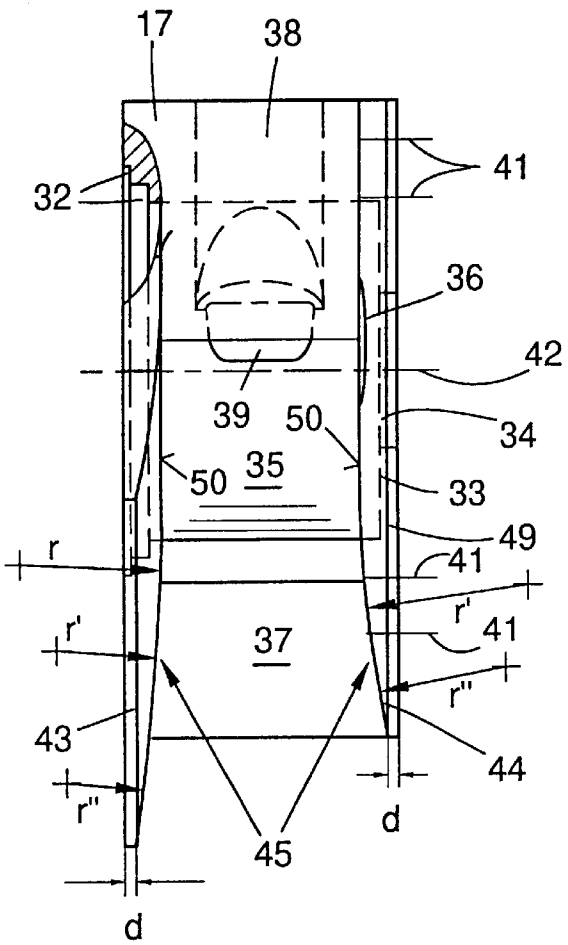
FIG. 5 is an end elevational view of the opening cylinder housing according to FIG. 4 as viewed along arrow Y thereof.

In the alternative embodiment according to FIGS. 4 and 5, the inner wall surfaces 45 of the side walls 43, 44 of the opening cylinder housing 17 are modified in comparison to the previously described embodiment of FIGS. 2, 3 such that, in this exemplary embodiment, the inner wall surfaces 45 are designed to be curved and consist of ring segment sections 50 arranged orthogonally to axis 42 of opening cylinder 21 and inner connection surfaces 51 which progressively curve outwardly from the ring segment sections 50. The inner connection surfaces 51 of side walls 43, 44, which face in opposition to each other thus extend in a divergent relation to one another. The radii r, r', r", etc. of their curvature are selected in such a manner that the inner connection surfaces 51 terminate in a wall edge 49 which has the same thickness "d" over its entire length.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A sliver opening device for an open-end spinning unit comprising an opening cylinder housing fixed to a pivotably mounted cover element for the spinning unit and supporting an opening cylinder for rotational sliver opening operation, the housing defining a sliver infeed position and a soil discharge opening located downstream of the sliver infeed position in the direction of rotation of the opening cylinder, the opening cylinder housing comprising side walls respectively arranged orthogonally in respect to the axis of the opening cylinder, the side walls having respectively opposing inner wall surfaces which diverge with respect to one another away from the opening cylinder toward a wall edge at least in the area of the soil discharge opening.

2. The sliver opening device according to claim 1, characterized in that the inner wall surfaces comprise respective inner sections arranged in parallel relation to one another and respective diverging edge sections connected to said inner sections.

3. The sliver opening device according to claim 2, characterized in that the edge sections comprise planar surfaces.

4. The sliver opening device according to claim 2, characterized in that the diverging edge sections are arranged at an angle to the inner sections of between 3° and 25°.

5. The sliver opening device according to claim 4, characterized in that the respective edge sections of the inner wall surfaces are oriented at a uniform angle relative to the respective inner sections.

6. The sliver opening device according to claim 4, characterized in that each inner wall surface has two angled edge sections oriented at different angles relative to the respective inner section.

7. The sliver opening device according to claim 1, characterized in that each of the side walls has an inner wall section with a ring segment section arranged orthogonally to the axis of the opening cylinder and a convexly curved inner connection surface to diverge increasingly toward the wall edge.

8. The sliver opening device according to claim 7, characterized in that the convexly curved inner connection surfaces terminate at the wall edge in a uniform thickness over the entire length of the wall edge.

9. The sliver opening device according to claim 1, characterized in that the opening cylinder housing is a single piece.

10. The sliver opening device according to claim 1, characterized in that the opening cylinder housing has a front side formed with a cylinder receiving opening having a dual graduated profile.

11. The sliver opening device according to claim 1, characterized in that the opening cylinder housing has a bore for replaceably receiving a fiber guide conduit.

12. The sliver opening device according to claim 11, characterized in that the bore has a step and is connected tangentially with respect to the cylinder receiving opening.

* * * * *